US011015806B2

(12) United States Patent
Reid et al.

(10) Patent No.: US 11,015,806 B2
(45) Date of Patent: May 25, 2021

(54) COMBUSTION DEVICE TEST APPARATUS AND METHOD

(71) Applicant: The Boeing Company, Chicago, IL (US)

(72) Inventors: Phillip C. Reid, Orange, CA (US); William G. Peterson, Sun City, CA (US)

(73) Assignee: The Boeing Company, Chicago, IL (US)

( * ) Notice: Subject to any disclaimer, the term of this patent is extended or adjusted under 35 U.S.C. 154(b) by 668 days.

(21) Appl. No.: 15/343,272

(22) Filed: Nov. 4, 2016

(65) Prior Publication Data

US 2018/0128484 A1 May 10, 2018

(51) Int. Cl.
*F23N 5/24* (2006.01)

(52) U.S. Cl.
CPC .... *F23N 5/247* (2013.01); *F23K 2900/05001* (2013.01); *F23N 2231/28* (2020.01)

(58) Field of Classification Search
CPC ..... F23N 5/247; F23N 2031/28; F23K 2900/05001
USPC ..... 431/2
See application file for complete search history.

(56) References Cited

U.S. PATENT DOCUMENTS 3,357,472 A * 12/1967 Rhodes ..... C25B 9/00 204/278
3,877,819 A * 4/1975 Haas ..... G01N 21/72 356/417
2011/0008739 A1* 1/2011 Mungas ..... F02K 9/566 431/346
2011/0068574 A1* 3/2011 Morgan ..... E21B 17/046 285/333
2013/0086949 A1* 4/2013 Charbonneau ..... F23D 14/64 65/134.4
2015/0247643 A1* 9/2015 Bebon ..... F24B 1/1804 126/541
2016/0215718 A1* 7/2016 Willcox ..... F02D 41/1401

OTHER PUBLICATIONS

Hydrogen Transportation Pipelines (2004), European Industrial Gases Association (Year: 2004).*
Micropropulsion Developments at AIT (2009), Martin Tajmar (Year: 2009).*
Addivitely Manufactured Propulsion System (Aug. 14, 2012). Small Satellite Conference. Matthew Dushku (Year: 2012).*

* cited by examiner

*Primary Examiner* — Steven B McAllister
*Assistant Examiner* — Allen R Schult
(74) *Attorney, Agent, or Firm* — Perman & Green LLP

(57) ABSTRACT

A combustion device test apparatus including a combustion device, a holding station configured to hold the combustion device, a fuel supply conduit, and a pressure wave fuse coupling the fuel supply conduit to the combustion device, the pressure wave fuse being frictionally coupled to one or more of the combustion device and the fuel supply conduit at a frictional coupling such that the pressure wave fuse is configured to disengage one or more of the combustion device and the fuel supply conduit at the frictional coupling upon traversal of a flame front pressure wave through the pressure wave fuse.

19 Claims, 4 Drawing Sheets

COMBUSTION DEVICE TEST APPARATUS AND METHOD

BACKGROUND

1. Field

The exemplary embodiments generally relate to combustion device test apparatus and in particular to laboratory combustion test devices.

2. Brief Description of Related Developments

Generally when developing new rocket propellants boundary conditions for the new rocket propellants must be established. Discovery of these boundary conditions generally occurs within a laboratory environment using small/micro scale combustion devices. During operation of the small/micro scale combustion devices there is a possibility of flashback when the combustion device is ignited. In one aspect, flashback arrestors are typically used to prevent any flame front caused by the flashback from reaching the propellant source. However, flashback arrestors may be expensive and may be used in large quantities during development of new rocket propellants. In addition, changing the flashback arrestors or other suitable flame front arresting device, as well as possible rebuilding of the test equipment after flashback occurs, may increase the time between tests thereby decreasing a rate of rocket propellant testing.

SUMMARY

The following is a non-exhaustive list of examples, which may or may not be claimed, of the subject matter according to the present disclosure.

One example of the subject matter according to the present disclosure relates to a combustion device test apparatus comprising a combustion device; a holding station configured to hold the combustion device; a fuel supply conduit; and a pressure wave fuse coupling the fuel supply conduit to the combustion device, the pressure wave fuse being frictionally coupled to one or more of the combustion device and the fuel supply conduit at a frictional coupling such that the pressure wave fuse is configured to disengage one or more of the combustion device and the fuel supply conduit at the frictional coupling upon traversal of a flame front pressure wave through the pressure wave fuse.

Another example of the subject matter according to the present disclosure relates to a combustion device test apparatus comprising a combustion device; a fuel supply conduit; and a pressure wave fuse comprising a conduit having a first end and a second end, the conduit being configured to transport fuel between the fuel supply conduit and the combustion device; wherein at least one of the first end and the second end of the conduit includes a frictional coupling surface that is configured to frictionally engage a respective one of the fuel supply conduit and the combustion device at a frictional coupling, the frictional coupling surface being configured so that the at least one of the first end and the second end of the pressure wave fuse disengages the respective one of the fuel supply conduit and the combustion device at the frictional coupling upon traversal of a flame front pressure wave through the pressure wave fuse.

Still another example of the subject matter according to the present disclosure relates to a method of testing a combustion device, the method comprising coupling a first end of a pressure wave fuse to a combustion device at a first coupling; and coupling a second end of the pressure wave fuse to a fuel supply conduit at a second coupling, where at least one of the first coupling and the second coupling are frictional couplings; wherein the pressure wave fuse automatically disengages from one or more of the first coupling and second coupling in response to a flame front pressure wave travelling through the pressure wave fuse.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIGS. 1A and 1B are schematic illustrations of a combustion device test apparatus in accordance with aspects of the present disclosure;

FIG. 2 is a schematic illustration of a portion of the combustion device test apparatus in accordance with aspects of the present disclosure;

FIG. 3 is a schematic illustration of a portion of the combustion device test apparatus in accordance with aspects of the present disclosure;

FIG. 4 is a schematic illustration of a portion of the combustion device test apparatus in accordance with aspects of the present disclosure; and FIG. 5 is a flow diagram of a method in accordance with aspects of the present disclosure.

DETAILED DESCRIPTION

Figure 1A:
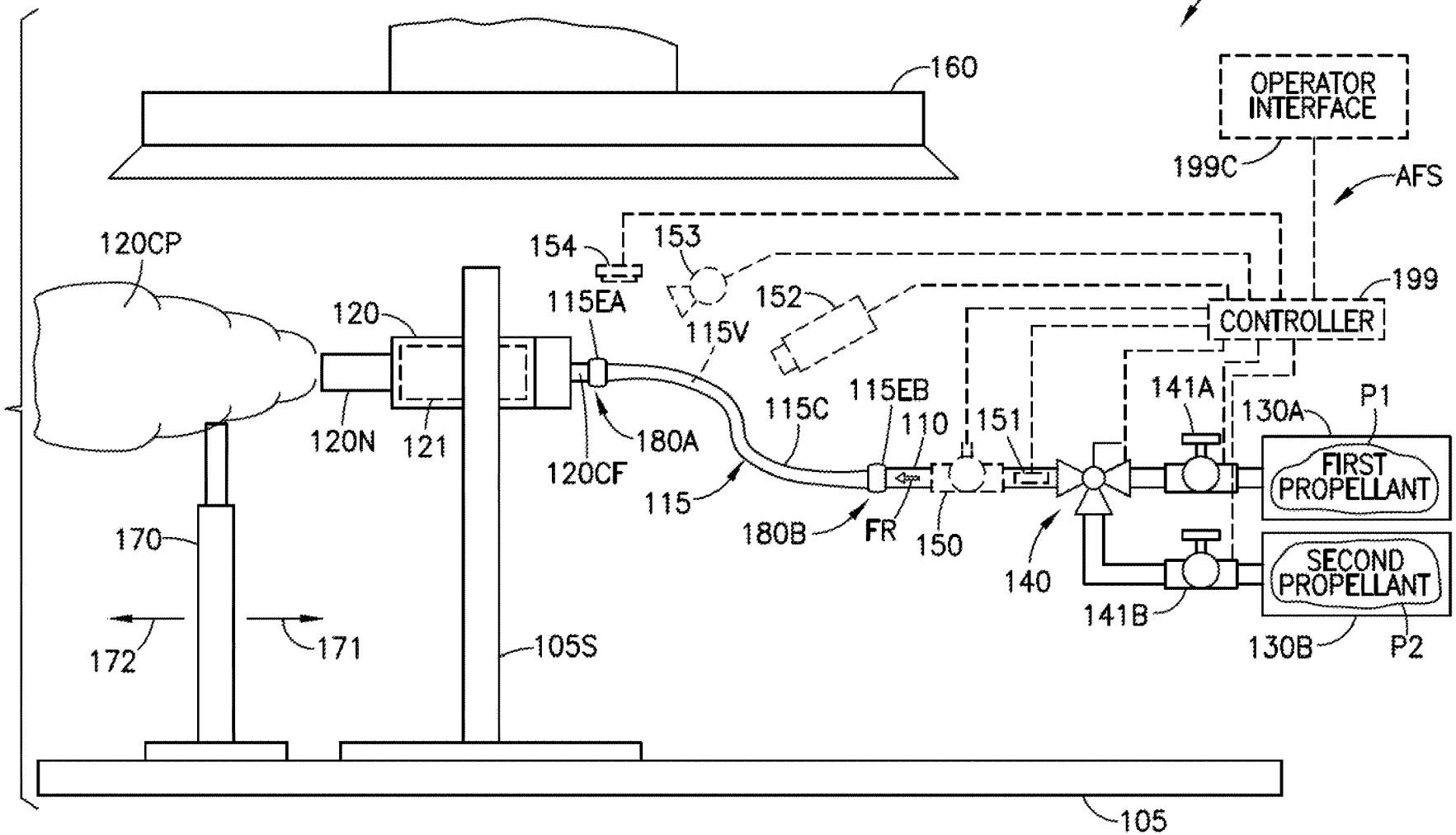

Referring to FIG. 1A, the combustion device test apparatus 100 of the present disclosure provides a simple cost effective flashback arresting device for premixed propellants. The combustion device test apparatus 100 increases the rate of, for example, rocket fuel and or rocket engine testing in that after flashback occurs a pressure wave fuse 115 of the combustion device test apparatus 100 may simply be reattached, without tools in a slip on manner, to establish connection between a combustion device 120 and a fuel supply conduit 110.

Illustrative, non-exhaustive examples, which may or may not be claimed, of the subject matter according to the present disclosure are provided below.

In one aspect, of the present disclosure the combustion device test apparatus 100 includes a holding station 105. The holding station 105 includes a mounting device 105S in which a combustion device 120 is held. In one aspect the combustion device 120 is a micro thruster test article but in other aspects the combustion device may be any suitable test article. An ignition source 170 is coupled to the holding station 105 in any suitable manner so as to be movable in at least directions 171, 172 for adjusting a position of the ignition source 170 relative to an exhaust nozzle 120N of the combustion device 120 such that a distance between the ignition source 170 and the combustion device 120 is variable.

The combustion device 120 is coupled to a fuel supply conduit 110 by a pressure wave fuse 115, which will be described in greater detail herein. In one aspect of the present disclosure, the fuel supply conduit 110 is configured to provide a mixture of propellants P1, P2 to the combustion device but in other aspects, a single propellant may be provided. For example, in one aspect, the propellants P1, P2 include a mixture of gaseous propellants, a mixture of liquid propellants, or a mixture of gaseous and liquid propellants.

The fuel supply conduit 110 may include one or more of a mixing valve 140 and a metering valve 141A, 141B. While both metering valves 141A, 141B and mixing valve 140 are illustrated in FIG. 1A it should be understood that in, some aspects, only the metering valves 141A, 141B or only the mixing valve 140 may be provided.

In the example illustrated in FIG. 1A there are two propellant sources 130A. 130B each being coupled to a respective one of the metering valves 141A. 141B; however, in other aspects there may be more (or less) than two propellant sources having a corresponding number of metering valves. Propellant P1, P2 from propellant sources 130A, 130B that is metered by the metering valves 141A, 141B flows to the mixing valve 140 where the propellants P1, P2 are mixed according to any suitable predetermined ratio. The mixed propellants flow from the mixing valve 140 through the pressure wave fuse 115 to the combustion device 120 where the ignition source 170 ignites the mixed propellants P1, P2 flowing from the exhaust nozzle 120N to produce combusted propellants 120CP.

In one aspect, one or more of the metering valves 141A, 141B and the mixing valve 140 are manually operated valves while in other aspects, one or more of the metering valves 141A, 141B and the mixing valve 140 may be computer controlled valves. For example, one or more of the metering valves 141A, 141B and/or the mixing valve 140 may be coupled to any suitable controller, such as controller 199, so as to be remotely controlled through an operator interface 199C. Remote control of one or more of the metering valves 141A, 141B and/or the mixing valve 140 may provide in operation adjustment of the propellant P1, P2 mixture from a location that is distant from the combustion device 120, pressure wave fuse 115 and/or propellant sources 130A. 130B.

Figure 1B:
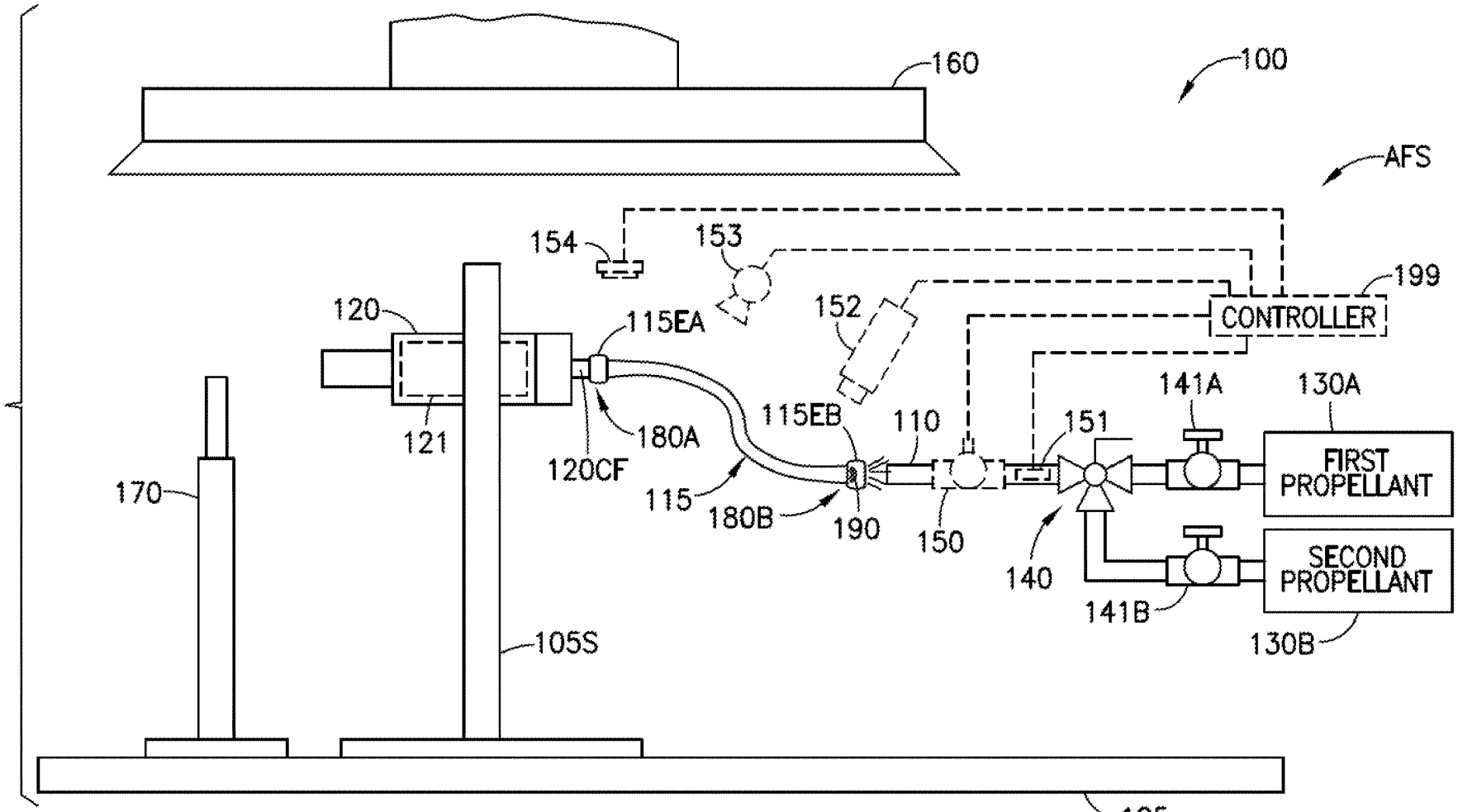

Referring also to FIG. 1B, the pressure wave fuse 115 is frictionally coupled to one or more of the combustion device 120 and the fuel supply conduit 110 at a frictional coupling 180A. 180B such that the pressure wave fuse 115 is configured to disengage one or more of the combustion device 120 and the fuel supply conduit 110 at the frictional coupling 180A, 180B upon traversal of a flame front pressure wave 190 through the pressure wave fuse 115. Referring again to FIG. 1A, in one aspect, the pressure wave fuse 115 comprises a conduit 115C having a first end 115EA and a second end 115EB, where at least one of the first end 115EA and the second end 115EB has a frictional coupling surface 115F (see FIG. 2) configured to frictionally engage a respective one of the combustion device 120 and the fuel supply conduit 110. The frictional coupling surface 115F may extend any suitable predetermined distance X into or through the conduit 115C, where in one aspect, the frictional coupling surface extends through the conduit and is common to both ends 115EA, 115EB of the conduit 115C.

In one aspect of the present disclosure, the pressure wave fuse 115 may be constructed of any suitable material such as, for example, a flexible polymer. In one aspect, the flexible polymer has elastic properties so that the pressure wave fuse 115 may be fit over (e.g. slipped over) the fuel supply conduit 110 and coupled to the combustion device 120 (e.g. slipped over a conduit connection fitting 120CF). In another aspect, the pressure wave fuse 115 may be constructed of any suitable elastic material. In still other aspects, the pressure wave fuse may be constructed of both substantially rigid and flexible/elastic portions where, for example at least one end 115EA, 115EB of the pressure wave fuse 115 comprises the flexible material while a portion of the pressure wave fuse bound by the ends 115EA, 115EB is substantially rigid. In one aspect of the present disclosure, the pressure wave fuse 115 is transparent so that any flame fronts generated when igniting the combustion device 120 may be visually observed travelling through the pressure wave fuse 115. In other aspects, the pressure wave fuse 115 may be transparent, translucent or opaque.

Figure 2:
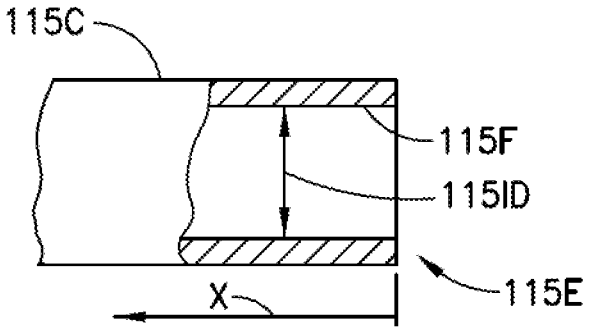
Figure 3:
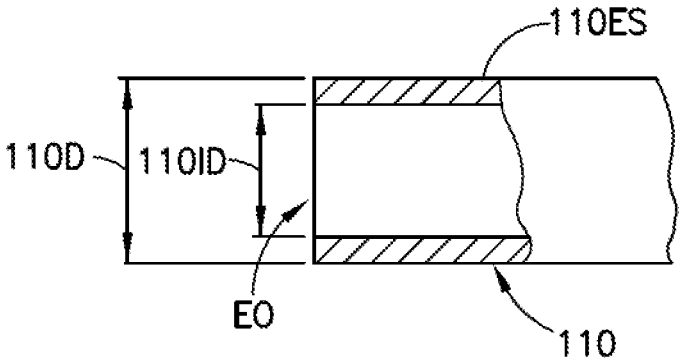
Figure 4:
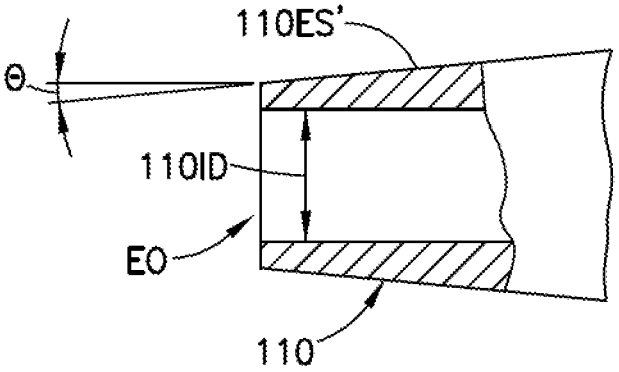

Referring to FIG. 2, an end 115E (which represents either first end 115EA or second end 115EB) of the pressure wave fuse 115 conduit 115C is illustrated. In this aspect, the frictional coupling surface 115F is located on an internal surface of the conduit 115C. As shown in FIG. 2, an internal diameter 115ID of the pressure wave fuse 115, at least in an area of the frictional coupling surface 115F, is smaller than an outer diameter 110D of the fuel supply conduit 110 as shown in FIGS. 3 and 4. In this aspect, an interference/press fit between the end 115E of the pressure wave fuse 115 and the fuel supply conduit 110 exists such that the external surface 110ES, 110ES' of the fuel supply conduit is frictionally engaged to the frictional coupling surface 115F of the pressure wave fuse 115. Coupling the pressure wave fuse 115 to the external surface 110ES, 110ES' of the fuel supply conduit 110 allows for the blow by (e.g. escape of gases past the frictional coupling) of unburned propellant P1, P2 and the flame front pressure wave 190 such that one or both ends 115EA, 115EB of the pressure wave fuse 115 expands (releasing the frictional coupling) and is driven off of the combustion device 120 conduit connection fitting 120CF and/or fuel supply conduit 110 by the escaping propellant P1, P2 and flame front pressure wave 190 such that one or both ends of the pressure wave fuse 115 is physically separated from the fuel supply conduit 110. In one aspect, the frictional coupling surface 115F may have any suitable texture to increase or decrease the amount of friction provided by the frictional coupling surface 115F. In one aspect, clip type retention members are provided on the pressure wave fuse 115 that engage corresponding retention members on the fuel supply conduit 110 and/or conduit connection fitting 120CF where the retention members are configured to separate upon a predetermined pressure (such as caused by the flame front pressure wave 190) within the pressure wave fuse 115. In one aspect of the present disclosure, as illustrated in FIG. 4, the external surface 110ES' of the fuel supply conduit 110 is tapered by any suitable angle θ, compared to the non-tapered or straight external surface 110ES of the fuel supply conduit 110 illustrated in FIG. 3. The tapered external surface 110ES' provides decreased coupling pressure and easier alignment to couple the pressure wave fuse 115 to the fuel supply conduit when compared to the non-tapered external surface 110ES. In one aspect, the fuel supply conduit 110 and/or conduit connection fitting 120CF is shaped to direct the pressure wave fuse 115 in a predetermined direction such as when the pressure wave fuse 115 decouples/disengages (as illustrated in FIG. 1B) from the fuel supply conduit 110 and/or conduit connection fitting 120CF under the influence of, for example, the flame front pressure wave 190.

In one aspect, the internal diameter 1151D of the pressure wave fuse 115 is sized relative to an internal diameter 110ID of the fuel supply conduit 110 so that a predetermined fuel flow rate is provided to the combustion device 120. For example, a ratio of the internal diameter 115ID of the pressure wave fuse 115 and the internal diameter 110ID of the fuel supply conduit 110 is proportional to a flow rate FR of fuel (e.g. flow rate of the mixed propellants P1, P2) being supplied by the fuel supply conduit 110 (e.g. flow rate«pressure wave fuse internal diameter/fuel supply conduit internal diameter). Here, a coefficient of static friction between the pressure wave fuse 115 and one or more of the fuel supply conduit 110 and the conduit connection fitting 120CF is overcome with a pressure build up inside the pressure wave fuse 115 near the interface between the pressure wave fuse 115 and one or more of the fuel supply conduit 110 and the conduit connection fitting 120CF. The coefficient of friction is a function of the hoop-strength of the pressure wave fuse 115 and the strength (e.g. the change in pressure) of the flame front pressure wave 190 (FIG. 1B) that causes the pressure wave fuse 115 to expand and separate from one or more of the fuel supply conduit 110 and the conduit connection fitting 120CF. In one aspect of the present disclosure, the internal diameter of the pressure wave fuse 115 is substantially the same diameter as or larger than the diameter of the exit orifice EO of the fuel supply conduit 110 (see FIGS. 3 and 4) such that as the fuel flow rate increases, the internal diameter 1151D of the pressure wave fuse 115 may be increased to control flow velocities. For example, and referring to FIG. 1, pressure wave fuses 115 with different internal diameters may be provided depending on a predetermined fuel flow rate FR to be tested where, for example, an internal volume 115V of the pressure wave fuse 115 is a function of fuel flow rate FR from the fuel supply conduit 110 to the combustion device 120. In one aspect, an internal volume 115V of the pressure wave fuse 115 is a function of a combustor volume 121 of the combustion device 120 so that a predetermined fuel flow rate is provided to the combustor volume 121.

In one aspect, the combustion device test apparatus 100 also includes an automatic fuel shut off system AFS that includes, an automatic shut off valve 150 disposed in the fuel supply conduit 110. The automatic fuel shut off system AFS may also include one or more of a pressure sensor 151, an optical sensor 152, an acoustic sensor 153 and a chemical sensor 154. The automatic shut off valve 150 and the one or more of a pressure sensor 151, an optical sensor 152, an acoustic sensor 153 and a chemical sensor 154 are coupled to any suitable controller, such as controller 199 such that the controller 199 operates the automatic shut off valve 150 to stop the flow of fuel based on suitable signals from one or more of a pressure sensor 151, an optical sensor 152, an acoustic sensor 153 and a chemical sensor 154 to the controller. For example, the pressure sensor 151 may be disposed within or is otherwise coupled to the fuel supply conduit 110 for sensing a pressure of the mixed propellants P1, P2 flowing through the fuels supply conduit. Upon sensing a pressure below a predetermined threshold, such as when the pressure wave fuse 115 detaches from one or more of the combustion device 120 and the fuel supply conduit 110, the pressure sensor 151 sends a signal to the controller 199 indicating a loss of pressure. The controller 199, in response to the loss of pressure signal from pressure sensor 151, is configured to operate the automatic shut off valve to stop the flow of mixed propellants P1, P2 flowing through the fuel supply conduit 110.

The optical sensor 152 may be coupled to the holding station 105 or otherwise positioned relative to the pressure wave fuse 115 for sensing a decoupling of the pressure wave fuse 115 from one or more of the combustion device 120 and the fuel supply conduit 110. For example, the controller 199 may be configured with any suitable optical recognition software (e.g. operating on images captured by the optical sensor 152) that detects movement of the pressure wave fuse 155 relative to the combustion device 120 and/or the fuel supply conduit 110. Upon detection of movement of the pressure wave fuse 115 relative to the combustion device 120 and the fuel supply conduit 110, such as when the pressure wave fuse 115 detaches from one or more of the combustion device 120 and the fuel supply conduit 110, the controller 199, in response to the detected movement, is configured to operate the automatic shut off valve to stop the flow of mixed propellants P1, P2 flowing through the fuel supply conduit 110.

The acoustic sensor 153 may be coupled to the holding station 105 or otherwise positioned relative to the pressure wave fuse 115 for sensing a pressure wave or sound wave occurring as a result of the decoupling of the pressure wave fuse 115 from one or more of the combustion device 120 and the fuel supply conduit 110. Upon sensing the pressure or sound wave, such as when the pressure wave fuse 115 detaches from one or more of the combustion device 120 and the fuel supply conduit 110, the acoustic sensor 153 sends a detection signal to the controller 199. The controller 199, in response to the detection signal from acoustic sensor 153, is configured to operate the automatic shut off valve to stop the flow of mixed propellants P1, P2 flowing through the fuel supply conduit 110.

The chemical sensor 154 may be coupled to the holding station 105 or otherwise positioned relative to the pressure wave fuse 115 for sensing the presence of the mixed propellants P1, P2 in the ambient environment surrounding the combustion device test apparatus 100, such as from the decoupling of the pressure wave fuse 115 from one or more of the combustion device 120 and the fuel supply conduit 110. Upon sensing the presence of the mixed propellants P1, P2, such as when the pressure wave fuse 115 detaches from one or more of the combustion device 120 and the fuel supply conduit 110, the chemical sensor 154 sends a detection signal to the controller 199. The controller 199, in response to the detection signal from chemical sensor 154, is configured to operate the automatic shut off valve to stop the flow of mixed propellants P1, P2 flowing through the fuel supply conduit 110.

The combustion device test apparatus 100 may also include an exhaust device 160 disposed adjacent the pressure wave fuse. The exhaust device 160 is configured to vent ambient atmosphere surrounding at least the pressure wave fuse 115 to a predetermined location, such as a filtration device or other suitable location.

Figure 5:
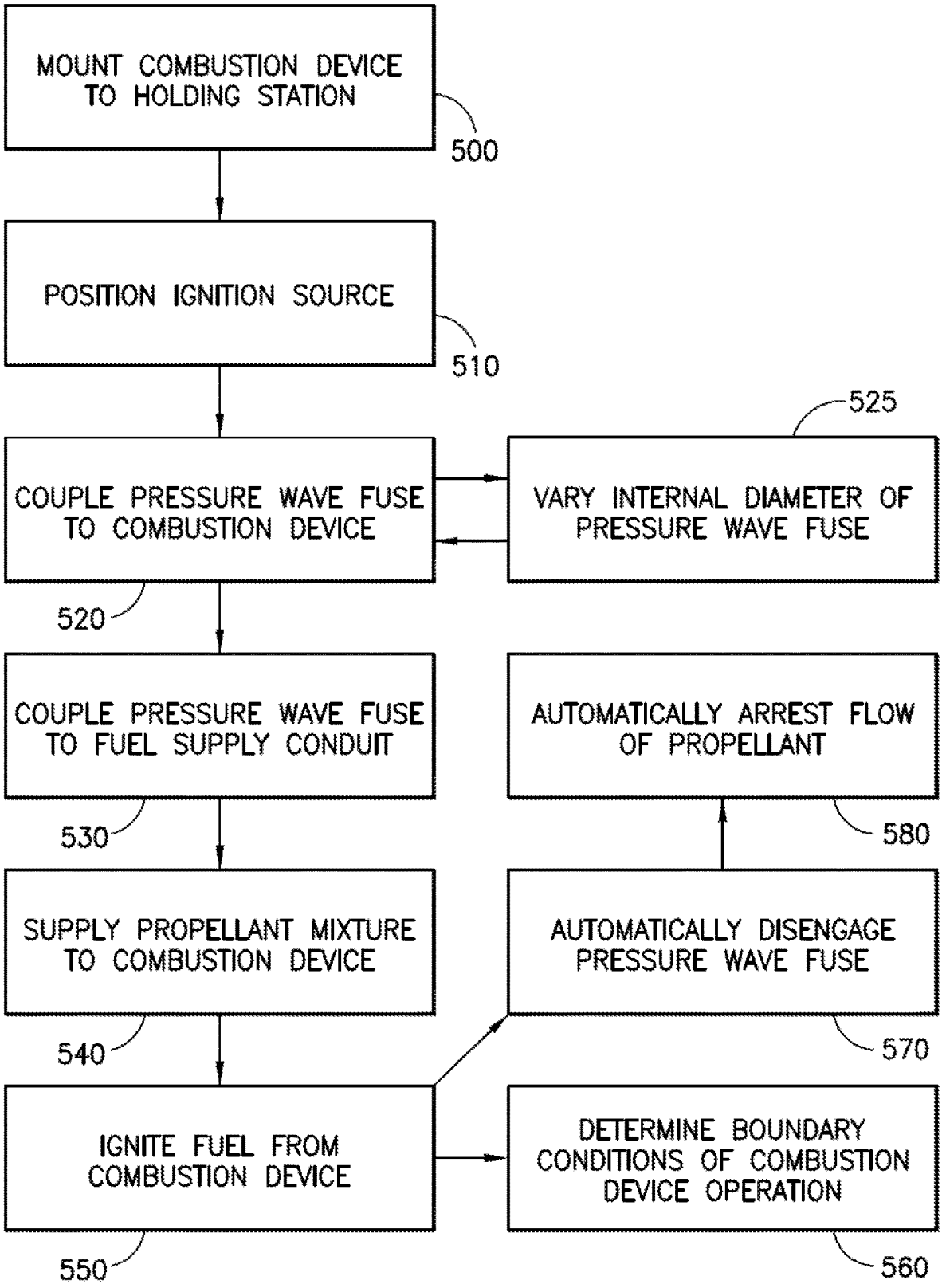

Referring now to FIGS. 1A, 1B and 5 an exemplary operation of the combustion device test apparatus 100 will be described. The combustion device 120 is coupled to, for example, the mounting device 105S of the holding station 105 (FIG. 5, Block 500). The ignition source 170 is positioned relative to the combustion device (FIG. 5, Block 510). The first end 115EA of the pressure wave fuse 115 is coupled to the combustion device at the first coupling 180A (FIG. 5, Block 520). The second end 115EB of the pressure wave fuse 115 is coupled to the fuel supply conduit 110 at the second coupling 180B (FIG. 5, Block 530). In one aspect, the internal diameter 115ID (see FIG. 2) of the pressure wave fuse 115 is varied (FIG. 5, Block 525) depending on, for example, a predetermined fuel flow rate FR. In one aspect, the internal diameter 115ID of the pressure wave fuse 115 is varied by selecting a pressure wave fuse 115 from a number of pressure wave fuses 115 each having a different internal diameter 115ID. The mixture of propellants P1, P2 is supplied to the combustion device such as by opening one or more of the mixing valve 140 and metering valves 141A, 141B (FIG. 5, Block 540). The mixed propellants P1, P2 exiting the nozzle 120N of the combustion device 120 are ignited by the ignition source 170 (FIG. 5, Block 550). In one aspect, where the ignition of the mixed propellants P1, P2 exiting the nozzle 120N does not cause a flame front pressure wave to travel back through the combustion device 120 into the pressure wave fuse 115, boundary conditions of combustion device 120 operation using the mixed propellants P1, P2 may be determined/discovered in any suitable manner (FIG. 5, Block 560). In one aspect, the boundary conditions may include, but are not limited to, minimum, fuel flow rates through the combustor for stable ignition, combustion temperature, a characteristic length (L-star) of the combustion device, a characteristic velocity (C-star) of the combustion device, fuel mixture ratio, operating pressures, etc.

Where the ignition of the mixed propellants P1, P2 exiting the nozzle 120N causes a flame front pressure wave to travel back through the combustion device 120 into the pressure wave fuse 115, the pressure wave fuse 115 automatically disengages (as illustrated in FIG. 1B) from one or more of the combustion device 120 at the first coupling 180A and the fuel supply conduit 110 at the second coupling 180B (FIG. 5, Block 570). For example, the flame front pressure wave, travelling ahead of the flame, travels through the pressure wave fuse 115 increasing the pressure within the pressure wave fuse 115. The increased pressure within the pressure wave fuse 115 acts upon one or more of the first coupling 180A and the second coupling 180B causing a release of the first coupling 180A and/or the second coupling 180B and subsequently the detachment of the pressure wave fuse 115 from one or more of the combustion device 120 and the fuel supply conduit 110. Upon detachment of the pressure wave fuse 115 the pressure within the pressure wave fuse 115 immediately decreases and may vent any unburned propellants P1. P2 and may arrest the flame (e.g. allowing the flame to burn out and any unburned propellants to dilute in the ambient atmosphere) without the flame entering the fuel supply conduit 110. The exhaust device 160 may also serve to dilute and evacuate the unburned propellants P1, P2 from the ambient atmosphere surrounding the combustion device test apparatus. In one aspect, one or more of the pressure sensor 151, optical sensor 152, acoustic sensor 153 and chemical sensor 154 may detect separation of the pressure wave fuse 115 such that the controller 199 operates the automatic shut off valve 150 so that the flow of propellant P1, P2 in the fuel supply conduit 110 is automatically stopped (FIG. 5, Block 580). The re-testing of the combustion device 120 and propellants P1, P2 may resume upon reattachment and/or replacement of the pressure wave fuse 115, where, as described above, the pressure wave fuse has a frictional coupling and is merely slid onto the combustion device 120 and/or fuel supply conduit 110 without the use of tools or other attachment devices (e.g. such as clamps, compression fittings, etc.).

While the aspects of the present disclosure are described herein with respect to micro/small scale combustion test devices it should be understood that that the aspects of the present disclosure may be scaled up as rocket engine size and equipment size increases during development and testing of, for example, new rocket fuels and/or rocket engine configurations.

The following are provided in accordance with the aspects of the present disclosure:

A1. A combustion device test apparatus comprising:

a combustion device:

a holding station configured to hold the combustion device;

a fuel supply conduit; and a pressure wave fuse coupling the fuel supply conduit to the combustion device, the pressure wave fuse being frictionally coupled to one or more of the combustion device and the fuel supply conduit at a frictional coupling such that the pressure wave fuse is configured to disengage one or more of the combustion device and the fuel supply conduit at the frictional coupling upon traversal of a flame front pressure wave through the pressure wave fuse.

A2. The combustion device test apparatus of claim A1, wherein the combustion device comprises a micro thruster test article.

A3. The combustion device test apparatus of claim A1, wherein the fuel supply conduit is configured to provide a mixture of propellants.

A4. The combustion device test apparatus of claim A3, wherein the mixture of propellants includes a mixture of gaseous propellants.

A5. The combustion device test apparatus of claim A3, wherein the mixture of propellants includes a mixture of liquid propellants.

A6. The combustion device test apparatus of claim A3, wherein the mixture of propellants includes a mixture of gaseous and liquid propellants.

A7. The combustion device test apparatus of claim A3, wherein the fuel supply conduit comprises one or more of a mixing valve and a metering valve.

A8. The combustion device test apparatus of claim A1, wherein the pressure wave fuse comprises a conduit having a first end and a second end, at least one of the first and the second end having a frictional coupling surface configured to frictionally engage a respective one of the combustion device and the fuel supply conduit.

A9. The combustion device test apparatus of claim A1, wherein the pressure wave fuse comprises a transparent conduit.

A10. The combustion device test apparatus of claim A1, wherein the pressure wave fuse comprises a flexible conduit.

A11. The combustion device test apparatus of claim A1, wherein at least a portion of the pressure wave fuse is elastic.

A12. The combustion device test apparatus of claim A1, further comprising an ignition source disposed adjacent the holding station, the ignition source being movably mounted with respect to the holding station such that a distance between the ignition source and the combustion device is variable.

A13. The combustion device test apparatus of claim A1, wherein a ratio of an internal diameter of the pressure wave fuse and an internal diameter of the fuel supply conduit is proportional to a flow rate of fuel being supplied by the fuel supply conduit.

A14. The combustion device test apparatus of claim A1, wherein an internal surface of the pressure wave fuse is frictionally coupled to an external surface of the fuel supply conduit.

A15. The combustion device test apparatus of claim A14, wherein the external surface of the fuel supply conduit comprises a tapered surface.

A16. The combustion device test apparatus of claim A1, wherein an internal diameter of the pressure wave fuse is substantially the same or larger than a diameter of an exit orifice of the fuel supply conduit (e.g. as flow rate of fuel increases internal diameter of fuse may increase to control flow velocities).

A17. The combustion device test apparatus of claim A1, wherein an internal volume of the pressure wave fuse is a function of a combustor volume of the combustion device (e.g. so that a predetermined fuel flow rate is provided to the combustor volume).

A18. The combustion device test apparatus of claim A1, wherein an internal volume of the pressure wave fuse is a function of fuel flow rate from the fuel supply conduit to the combustion device.

A19. The combustion device test apparatus of claim A1, further comprising an automated valve configured to stop a flow of fuel through the fuel supply conduit upon separation of the pressure wave fuse from one or more of the fuel supply conduit and the combustion device (e.g. activated audibly, by pressure sensors in communication with fuel supply conduit and/or pressure fuse, optical sensors, chemical sensors disposed adjacent fuse to detect presence of fuel in ambient surroundings, etc.).

A20. The combustion device test apparatus of claim A1, further comprising an exhaust device disposed adjacent the pressure wave fuse, the exhaust device being configured to vent ambient atmosphere surrounding at least the pressure wave fuse.

B1. A combustion device test apparatus comprising:

a combustion device;

a fuel supply conduit; and a pressure wave fuse comprising a conduit having a first end and a second end, the conduit being configured to transport fuel between the fuel supply conduit and the combustion device;

wherein at least one of the first end and the second end of the conduit includes a frictional coupling surface that is configured to frictionally engage a respective one of the fuel supply conduit and the combustion device at a frictional coupling, the frictional coupling surface being configured so that the at least one of the first end and the second end of the pressure wave fuse disengages the respective one of the fuel supply conduit and the combustion device at the frictional coupling upon traversal of a flame front pressure wave through the pressure wave fuse.

B2. The combustion device test apparatus of claim B1, wherein the combustion device comprises a micro thruster test article.

B3. The combustion device test apparatus of claim B1, wherein the fuel supply conduit is configured to provide a mixture of propellants.

B4. The combustion device test apparatus of claim B3, wherein the mixture of propellants includes a mixture of gaseous propellants.

B5. The combustion device test apparatus of claim B3, wherein the mixture of propellants includes a mixture of liquid propellants.

B6. The combustion device test apparatus of claim B3, wherein the mixture of propellants includes a mixture of gaseous and liquid propellants.

B7. The combustion device test apparatus of claim B3, wherein the fuel supply conduit comprises one or more of a mixing valve and a metering valve.

BB. The combustion device test apparatus of claim B1, further comprising a holding station configured to hold the combustion device.

B9. The combustion device test apparatus of claim B8, further comprising an ignition source disposed adjacent the holding station, the ignition source being movably mounted with respect to the holding station such that a distance between the ignition source and the combustion device is variable.

B10. The combustion device test apparatus of claim B1, wherein the pressure wave fuse comprises a transparent conduit.

B11. The combustion device test apparatus of claim B1, wherein the pressure wave fuse comprises a flexible conduit.

B12. The combustion device test apparatus of claim B1, wherein at least a portion of the pressure wave fuse is elastic.

B13. The combustion device test apparatus of claim B1, wherein a ratio of an internal diameter of the pressure wave fuse and an internal diameter of the fuel supply conduit is proportional to a flow rate of fuel being supplied by the fuel supply conduit.

B14. The combustion device test apparatus of claim B1, wherein an internal surface of the pressure wave fuse comprises the frictional coupling surface, where the frictional coupling surface is coupled to an external surface of the fuel supply conduit.

B15. The combustion device test apparatus of claim B14, wherein the external surface of the fuel supply conduit comprises a tapered surface.

B16. The combustion device test apparatus of claim B1, wherein an internal diameter of the pressure wave fuse is substantially the same or larger than a diameter of an exit orifice of the fuel supply conduit (e.g. as flow rate of fuel increases internal diameter of fuse may increase to control flow velocities).

B17. The combustion device test apparatus of claim B1, wherein an internal volume of the pressure wave fuse is a function of a combustor volume of the combustion device (e.g. so that a predetermined fuel flow rate is provided to the combustor volume).

B18. The combustion device test apparatus of claim B1, wherein an internal volume of the pressure wave fuse is a function of fuel flow rate from the fuel supply conduit to the combustion device.

B19. The combustion device test apparatus of claim B1, further comprising an automated valve configured to stop a flow of fuel through the fuel supply conduit upon separation of the pressure wave fuse from one or more of the fuel supply conduit and the combustion device (e.g. activated audibly, by pressure sensors in communication with fuel supply conduit and/or pressure fuse, optical sensors, chemical sensors disposed adjacent fuse to detect presence of fuel in ambient surroundings, etc.).

B20. The combustion device test apparatus of claim B1, further comprising an exhaust device disposed adjacent the pressure wave fuse, the exhaust device being configured to vent ambient atmosphere surrounding at least the pressure wave fuse.

C1. A method of testing a combustion device, the method comprising:

coupling a first end of a pressure wave fuse to a combustion device at a first coupling; and coupling a second end of the pressure wave fuse to a fuel supply conduit at a second coupling, where at least one of the first coupling and the second coupling are frictional couplings;

wherein the pressure wave fuse automatically disengages from one or more of the first coupling and second coupling in response to a flame front pressure wave travelling through the pressure wave fuse.

C2. The method of claim C1, further comprising determining boundary conditions of combustion device operation using fuel provided through the fuel supply conduit.

C3. The method of claim C1, further comprising flowing a premixed propellant from the fuel supply conduit to the combustion device through the pressure wave fuse.

C4. The method of claim C1, further comprising varying an internal diameter of the pressure wave fuse depending on a predetermined flow rate of propellant to the combustion device.

C5. The method of claim C1, further comprising automatically arresting a flow of propellant through the fuel supply conduit upon disengagement of the pressure wave fuse from one or more of the first coupling and second coupling.

In the figures, referred to above, solid lines, if any, connecting various elements and/or components may represent mechanical, electrical, fluid, optical, electromagnetic, wireless and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the drawings may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in the figures, may be combined in various ways without the need to include other features described in the figures, other drawing figures, and/or the accompanying disclosure, even though such combination or combinations are not explicitly illustrated herein. Similarly, additional features not limited to the examples presented, may be combined with some or all of the features shown and described herein.

In FIG. 5, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIG. 5 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the foregoing description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus (es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims, if any, are presented for illustrative purposes only and are not intended to limit the scope of the claimed subject matter to the specific examples provided in the present disclosure.

What is claimed is:

1. A combustion device test apparatus comprising:

a micro thruster test article;

a holding station configured to hold the micro thruster test article;

a fuel supply conduit; and a pressure wave fuse coupling the fuel supply conduit to the micro thruster test article, the pressure wave fuse being frictionally coupled to the micro thruster test article and the fuel supply conduit at a frictional coupling such that the pressure wave fuse is configured to resiliently expand so that expansion of the pressure wave fuse and a gas flow at the frictional coupling between the pressure wave fuse and one or more of the micro thruster test article and the fuel supply conduit releases the frictional coupling to disengage the pressure wave fuse from the one or more of the micro thruster test article and the fuel supply conduit at the frictional coupling upon traversal of a flame front pressure wave through the pressure wave fuse;

wherein the fuel supply conduit is configured to provide a mixture of propellants and the fuel supply conduit comprises one or more of a mixing valve and a metering valve.

2. The combustion device test apparatus of claim 1, wherein the pressure wave fuse comprises a transparent conduit.

3. The combustion device test apparatus of claim 1, wherein the pressure wave fuse comprises a flexible conduit.

4. The combustion device test apparatus of claim 1, wherein the mixture of propellants includes a mixture of gaseous propellants.

5. The combustion device test apparatus of claim 1, wherein the mixture of propellants includes a mixture of liquid propellants.

6. The combustion device test apparatus of claim 1, wherein the mixture of propellants includes a mixture of gaseous and liquid propellants.

7. The combustion device test apparatus of claim 1, further comprising an exhaust device disposed adjacent the pressure wave fuse, the exhaust device being configured to vent ambient atmosphere surrounding at least the pressure wave fuse.

8. The combustion device test apparatus of claim 1, wherein the pressure wave fuse comprises a conduit having a first end and a second end, at least one of the first and the second end having a frictional coupling surface configured to frictionally engage a respective one of the micro thruster test article and the fuel supply conduit.

9. The combustion device test apparatus of claim 1, further comprising an ignitor disposed adjacent the holding station, the ignition source being movably mounted with respect to the holding station such that a distance between the ignition source and the micro thruster test article is variable, the ignition source being configured to ignite propellants from the micro thruster test article.

10. The combustion device test apparatus of claim 1, further comprising an automated valve configured to stop a flow of fuel through the fuel supply conduit upon separation of the pressure wave fuse from one or more of the fuel supply conduit and the micro thruster test article.

11. A combustion device test apparatus comprising:

a micro thruster test article;

a fuel supply conduit;

a pressure wave fuse comprising a conduit having a first end and a second end, the conduit being configured to transport fuel between the fuel supply conduit and the micro thruster test article; and an automated valve configured to stop a flow of fuel through the fuel supply conduit upon separation of the pressure wave fuse from one or more of the fuel supply conduit and the micro thruster test article;

wherein at least one of the first end and the second end of the conduit includes a frictional coupling surface that is configured to frictionally engage a respective one of the fuel supply conduit and the micro thruster test article at a frictional coupling, the frictional coupling surface being configured to resiliently expand so that the frictional coupling surface of the at least one of the first end and the second end of the pressure wave fuse expands to and a gas flow between the frictional coupling surface the respective one of the fuel supply conduit and the micro thruster test article disengages the pressure wave fuse from the respective one of the fuel supply conduit and the micro thruster test article at the frictional coupling upon traversal of a flame front pressure wave through the pressure wave fuse.

12. The combustion device test apparatus of claim 11, wherein the fuel supply conduit is configured to provide a mixture of propellants.

13. The combustion device test apparatus of claim 12, wherein the fuel supply conduit comprises one or more of a mixing valve and a metering valve.

14. The combustion device test apparatus of claim 11, further comprising a holding station configured to hold the micro thruster test article.

15. A method of testing a micro thruster test article, the method comprising:

coupling a first end of a pressure wave fuse to a micro thruster test article at a first coupling; and coupling a second end of the pressure wave fuse to a fuel supply conduit at a second coupling, where at least one of the first coupling and the second coupling are frictional couplings;

wherein:

the pressure wave fuse expands so that expansion of the pressure wave fuse and a gas flow at one or more of the first coupling and the second coupling between the pressure wave fuse and one or more of the micro thruster test article and the fuel supply conduit releases the one or more of the first coupling and the second coupling to automatic disengage the pressure wave fuse from the one or more of the first coupling and the second coupling in response to a flame front pressure wave travelling through the pressure wave fuse, and the fuel supply conduit is configured to provide a mixture of propellants and the fuel supply conduit comprises one or more of a mixing valve and a metering valve.

16. The method of claim 15, further comprising determining boundary conditions of the micro thruster test article operation using fuel provided through the fuel supply conduit.

17. The method of claim 16, further comprising flowing a premixed propellant from the fuel supply conduit to the micro thruster test article through the pressure wave fuse.

18. The method of claim 16, further comprising varying an internal diameter of the pressure wave fuse depending on a predetermined flow rate of propellant to the micro thruster test article.

19. The method of claim 15, further comprising automatically arresting a flow of propellant through the fuel supply conduit upon disengagement of the pressure wave fuse from one or more of the first coupling and second coupling.

* * * * *